United States Patent [19]

Uherek, Sr. et al.

[11] Patent Number: 4,889,185

[45] Date of Patent: Dec. 26, 1989

[54] BLAST JOINT

[76] Inventors: Robert J. Uherek, Sr., 2804 S.E. Dunes Dr. 1309, Stuart, Fla. 34996; Jack R. Claycomb, 8226 Waynemer, Houston, Tex. 77040

[21] Appl. No.: 121,907

[22] Filed: Nov. 17, 1987

[51] Int. Cl.[4] ..... E21B 17/10; F16L 55/00

[52] U.S. Cl. ..... 166/243; 166/902; 285/45; 138/147

[58] Field of Search ..... 166/236, 243, 902, 77.5; 285/45; 138/147, DIG. 6; 175/423

[56] References Cited

U.S. PATENT DOCUMENTS

| | | | |
|---|---|---|---|
| 3,094,852 | 6/1963 | Taylor | 166/77.5 |
| 4,028,796 | 6/1977 | Bergstrom | 166/243 |
| 4,141,386 | 2/1979 | Bergstrom | 166/243 |
| 4,211,440 | 7/1980 | Bergstrom | 138/147 |
| 4,380,347 | 3/1983 | Sable | 285/45 |
| 4,381,821 | 5/1983 | Greene, Jr. | 166/243 |
| 4,613,165 | 9/1986 | Kuhne | 138/147 |
| 4,635,968 | 1/1987 | Kuhne | 138/147 |

*Primary Examiner*—Jerome W. Massie, IV
*Assistant Examiner*—Terry Lee Melius

[57] ABSTRACT

A multi-joint blast joint comprising a series of standard length joints of production tubing is disclosed. The blast joint includes a series of cylindrical rings composed of an abrasion resistant material mounted about the tubular tubing joints forming a protective shield about the production tubing. A movable sleeve formed of cylindrical abrasion resistant rings is selectively shiftable to enclose and shield the tubing connection assemblies joining the production tubing forming the blast joint. A slip sleeve is mounted about the blast joint providing a pipe slip engaging surface for suspending the blast joint in the well bore. The production tubing and abrasion resistant rings form a blast joint whose length exceeds the standard length of a single joint of production tubing.

12 Claims, 3 Drawing Sheets

BLAST JOINT

BACKGROUND OF THE DISCLOSURE

The present invention is directed to a blast joint, particularly, a blast joint comprising a series of blast joint modules connected to form a blast joint having a length exceeding the standard length of production tubing for use in production zones of substantial thickness.

It is common when drilling oil and gas wells to encounter two or more producing formations or zones. In such a situation, each producing formation is produced through a separate string of production tubing extending into the well bore. Typically, a string of production tubing extends to the lowermost producing formation. A packer is set about the production tubing string between the producing formations to isolate the upper producing formation from the lower producing formation. A second string of production tubing extends into the well bore to the upper producing formation. A packer is set above the upper producing formation to close off the annulus about the two strings of production tubing so that the upper production zone is isolated between the two packers. Thus, each string of production tubing is in fluid communication with the producing formation adjacent the lower open end of the production tubing. This is commonly referred to as a dual completion well.

Downhole well equipment is exposed to erosive elements in the well bore. This is particularly true in a dual completion well where one string of production tubing extends through an upper producing zone. Flow into the well bore in the upper producing zone, particularly in formations producing high pressure gas, is at high velocities. Abrasive materials, such as unconsolidated sand grains, are often entrained in the fluid stream and impinge on the production tubing. This action is extremely abrasive and erodes the pipe surface, thus requiring replacement of the production tubing. This is a very time consuming process which may be repeated often, particularly of wells having high sand content.

The errosiveness of producing fluids is well known in the prior art and many different efforts have been made to solve the problem. U.S. Pat. No. 4,381,821 discloses a series of elements composed of an abrasive resistant material mounted about a tubular member. The elements form a protection ring about the tubing and are supported on the tubular member by upper and lower supports which provide tongue and groove engagement with the upper end of an upper ring and with the lower end of a lower ring.

U.S. Pat. No. 3,379,269 discloses a system for protecting the production tubing comprising a plurality of baffle sleeves concentrically mounted about the production tubing in the area of an upper producing formation. Each of the sleeves includes perforations which are staggered in relation to perforations in the next adjacent sleeve so that the erosive fluid entering the well is forced to follow a tortious flow path before it impinges on the production tubing. The changing flow path causes the erosive fluid to decrease its kinetic energy and reduce its impact velocity before it reaches the production tubing, thereby reducing erosion of the tubing.

U.S. Pat. Nos. 4,141,368 and, 4,028,796 to Bergstrom disclose a blast joint comprising a series of short cylindrical rings composed of cemented tungsten carbide and the method of producing a blast joint for oil well production tubing. The rings are disposed coaxially in contact with each other between end retaining rings mounted upon a supporting steel tube which comprises a single section or joined sections of production tubing.

In U.S. Pat. No. 4,211,440, Bergstrom suggests that the successful functioning of the blast joint in a well is dependent upon the handling of the blast joint before it is positioned in the well. To this end, Bergstrom discloses the introduction of a yieldable compression spring encircling the production tubing and disposed between the end of the carbide rings and the ring retaining clamp to allow freedom of movement of the rings relative to the tubing to permit handling and moving of the assembled blast joint without damage to the carbide rings.

The use of blast joints as protective structures for protecting production tubing is well recognized in the prior art. However, blast joints of the prior art are typically limited to providing protection of a single joint of production tubing. If a blast joint of an extended length is required, a series of tubing joints or pipe joined by a flush joint are used to form the blast joint. The prior art method of forming blast joints having flush joint connections is exemplified by U.S. Pat. No. 4,028,796 to Bergstrom. Flush joints, however, substantially reduce the tensile strength of the production tubing string at the flush joint connection. The blast joint of the present disclosure overcomes the disadvantages of flush joint connections by providing a shielded connection assembly for joining the threaded pin end of a tubular member to the threaded box end of a tubular member connected therewith to form the blast joint.

Another limitation of prior art blast joint structures is that typically special equipment is required to support the blast joint in the well bore for connection to the tubing string. In U.S. Pat. No. 4,685,518 entitled BLAST JOINT and U.S. patent application Ser. No. 038,145, filed on Apr. 14, 1987, entitled BLAST JOINT which patent and application are assigned to the same assignee as this invention, and which disclosures are incorporated by reference herein, there is disclosed a base assembly for use during the installation process of the blast joints. The base assembly permits the installation of the blast joint without cracking, chipping or otherwise subjecting the carbide rings to high localized compressive stresses. The carbide rings are very brittle and easily crack if subjected to excessive lateral force.

While the base assembly disclosed in the above noted patent and patent application is suitable for its intended purposes, it is nevertheless somewhat cumbersome to use on the drill rig floor. Hence, a need existed for a simple and inexpensive apparatus for supporting the blast joint in the rotary table of the drilling rig for connection to the production tubing string.

U.S. Pat. No. 4,635,968 to Kuhne discloses a multi-joint blast joint. The blast joint of Kuhne is formed by suspending a tubular member having a plurality of rings mounted thereon in the well bore. Pipe slips are used to suspend the tubular member in the well bore. The pipe slips engage the tubular member about an area not covered by the protective rings. A subsequent tubular member is coupled to the tubular member suspended in the well bore and the protective rings are thereafter lowered to enclose the coupling connection.

While the above prior art apparatus and methods provide a means for forming a multi-joint blast joint, specialized equipment or substantial effort on the part of the rig personnel is required to connect the multi-joint blast joint in the tubing string. It is therefore an object of the present invention to provide a blast joint construction which substantially eliminates the need for specialized equipment to install multi-joint blast joints.

It is a further object of this invention to provide a multi-joint blast joint requiring little or no special handling by rig personnel.

It is a further object of the present invention to provide a multi-joint blast joint which may be suspended in the well bore utilizing pipe slips which engage the blast joint in a typical manner.

SUMMARY OF THE DISCLOSURE

The invention of the present disclosure is directed to an improved blast joint of substantial length. The blast joint of the invention includes erosion resistant rings mounted about tubular members connected end to end. The pin and box ends of the tubular members are connected by a cross-over connector assembly which is shielded from erosive elements by an adjustable erosion resistant coupling shield which is positioned to enclose the cross-over connector assembly prior to positioning the blast joint in the well bore. The erosion resistant rings are compressed between end located retaining collars permitting some degree of movements of the erosion resistant rings relative to the supporting tubular members. A slip sleeve is mounted below the box end of the tubular members for providing a pipe slip engaging surface for suspending the tubular member in the well bore.

BRIEF DESCRIPTION OF THE DRAWINGS

So that the manner in which the above recited features, advantages and objects of this invention as well as others which will become apparent are attained and can be understood in detail, a more particular description of the invention, briefly summarized above, may be had by reference to the embodiments thereof that are illustrated in the appended drawings, which drawings form a part of this specification.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
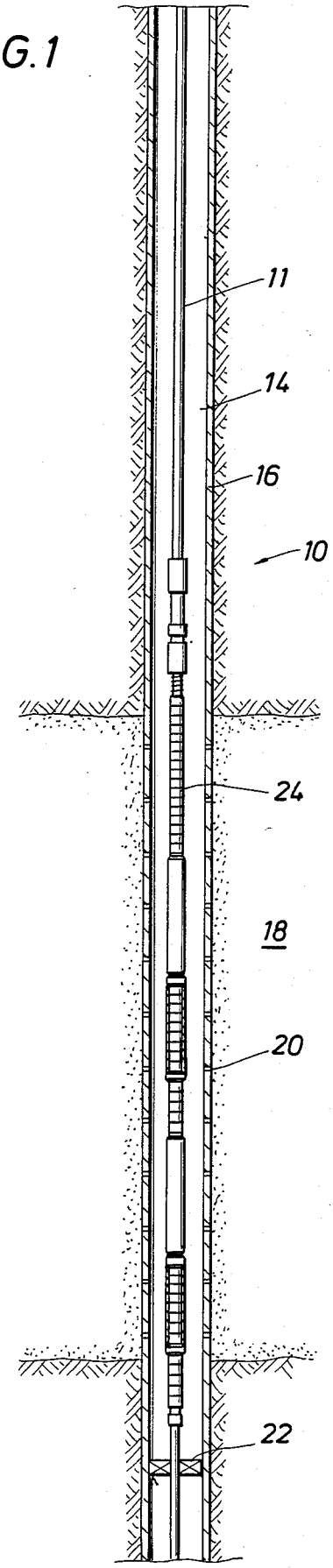
FIG. 1 is a side elevational view of a production string in a well bore showing the improved blast joint of the present invention protecting the production tubing in the interval of a producing formation.

Referring first to FIG. 1, the improved blast joint of the present disclosure is generally identified by the reference numeral 10. The blast joint 10 forms a part of a production tubing string 11 which extends in a well bore 14. The well bore 14 is defined by a casing string 16 traversing a producing formation 18. The casing 16 is provided with a plurality of perforations 20 which define an open production interval in the formation 18.

A packer 22 is disposed between the producing formation 18 and a lower producing formation (not shown in the drawings) in order to isolate these formations from one another so that there is no communication between these formations within the well. A production tubing string 11 is disposed in the well bore 14 as illustrated and extends from the well head to below the packer 22 to the lower formation. Fluids form the lower formation thus are produced through the interior of the production tubing string 11 and carried to the surface of the well for delivery to a storage tank facility. Fluids produced from the formation 18 flow to the surface in the annular space between the production tubing string 22 and the casing 16. If desired, a second packer may be disposed above the formation 18 and a second tubing string provided in the well bore 14 and terminating adjacent the perforations 20 providing a production passage to the surface of fluids produced from the formation 18.

The production equipment thus far described is conventional. Also, it will be understood that the downhole arrangement thus far described is illustrative only and other suitable arrangements may be used. For example, the well bore 14 may be cased or uncased. Alternatively, the well bore 14 may be partially cased and partially uncased. Other well completion practices are also available and are well known to those skilled in the art.

In accordance with the present disclosure, there is disposed within the well bore 14 a production tubing 11 which is in fluid communication with a producing formation or zone below the producing formation 18. The blast joint 10 forms a portion of the production tubing string 11 and is disposed in the well bore opposite the producing interval of the formation 18 defined by the perforations 20. The blast joint 10 is a protective sheath or shield of erosion resistant material which encloses a portion of the production tubing string 11 to protect it from the erosive action of the high velocity fluid and entrailed particles entering the well bore 14 through the perforations 20. The erosion resistant material forming the blast joint of the present disclosure may be made of any suitable material exhibiting erosion resistant properties. In the preferred embodiment, however, described in greater detail hereinafter, the erosion resistant material is tungsten carbide formed in rings which are stacked end to end and carried on the tubular members forming the blast joint 10 between end located retention clamps. Ceramic is also a suitable erosion resistant material which may be used to form the blast joint of the present disclosure.

Figure 2A:
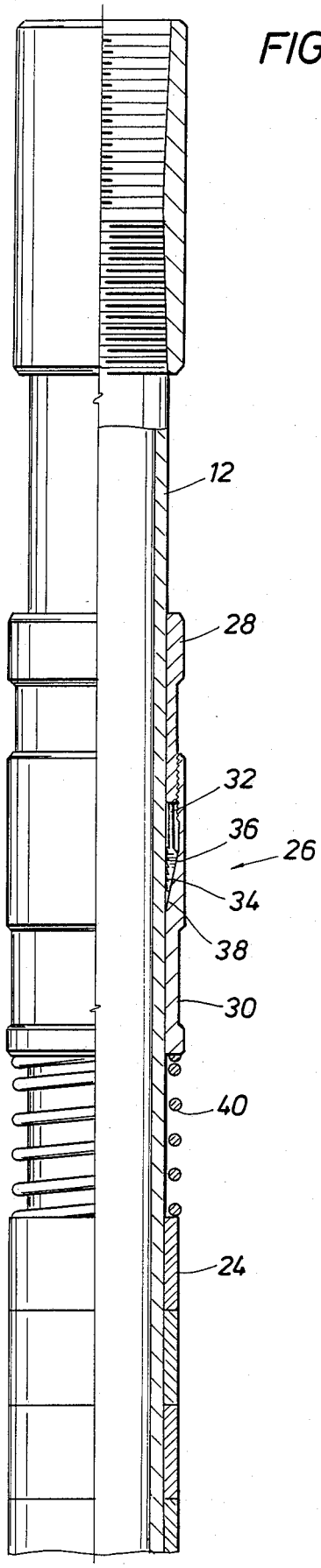
FIG. 2A is a partial, vertical, longitudinal, sectional view of the improved blast joint of the present invention showing the upper retention collar.
Figure 2B:
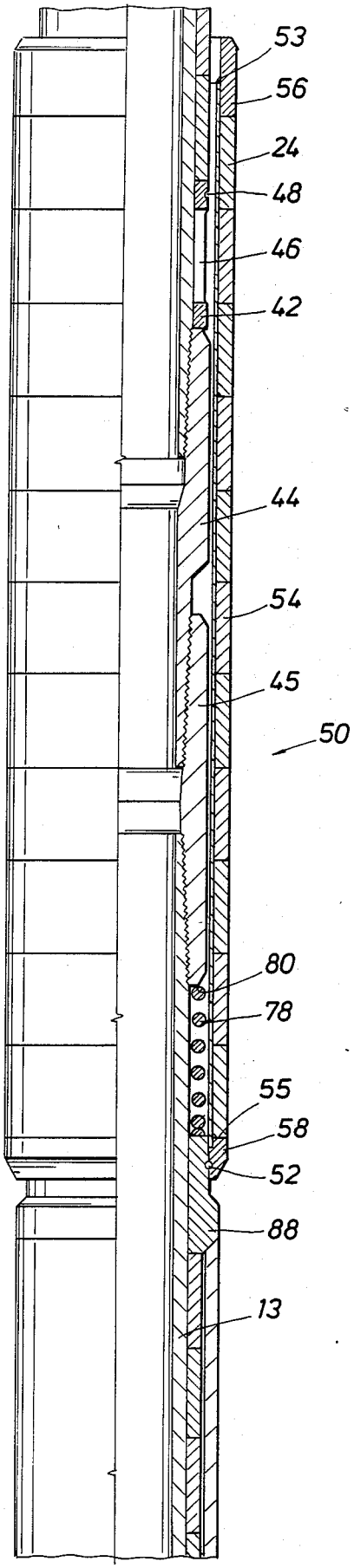
FIG. 2B is a similar vertical, longitudinal, sectional view of the improved blast joint of the present invention showing the erosion resistant coupling shield assembly enclosing the tubing connector assembly.
Figure 2C:
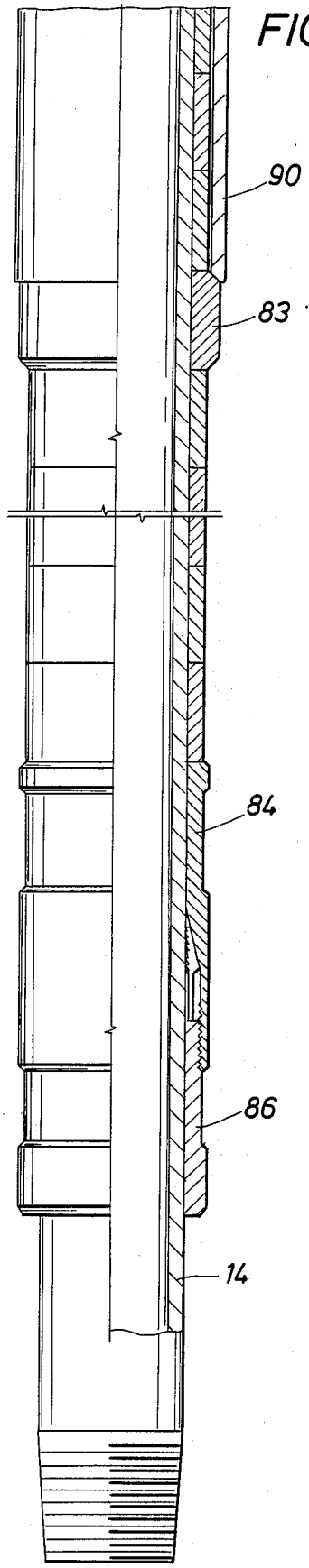
FIG. 2C is a similar vertical, longitudinal, sectional view of the improved blast joint of the present invention showing the slip sleeve mounted about the erosion resistant rings on the tubular member.

Referring now to FIGS. 2A through 2C, the blast joint 10 of the present disclosure will be described from top to bottom. The blast joint of the present disclosure shown in FIGS. 2A through 2C comprises several tubular members joined end to end in a manner to be described. For example, the blast joint 10 of the present disclosure may comprise one or more joints of production tubing joined together and encased by erosion resistant rings 24. The blast joint 10 is incorporated in the production tubing string 11 disposed within the well bore 14 as shown in FIG. 1.

The upper portion of the blast joint 10 comprises a plurality of rings 24 assembled on a tubing member 12 in end face to face contact and are held in compression between end located locking assemblies 26. At the upper end of the blast joint 10, the locking assembly 26 comprises a slip ring 28 and a bowl ring 20 threadedly engaged about the tubing 12. Initially, the locking assembly 26 is slipped over the pin end of the tubing 12 and clamped thereon at a desired location. The slip ring 28 includes a plurality of flexible fingers 32 extending from a threaded portion thereof, The fingers 32 are provided with a serrated surface 34 for engaging the surface of the tubing 12. The fingers 32 includes a tapered external surface 36 which coacts with an oppositely tapered surface 38 formed on the internal body of the bowl ring 30 to compress the fingers 32 in locking engagement with the tubing 12.

After the locking ring assembly 26 is clamped to the tubing 12, a spring 40 and a plurality of carbide rings 24 are slid over the pin end of the tubing 12. The carbide rings 24 fit snugly on the tubing 12 and abut against the spring 40. The number of carbide rings 24 mounted on the tubing 12 may vary depending upon the axial length of each ring; however, a sufficient number of carbide rings 24 are used to totally encase the tubing 12 from the spring 40 to a support ring 42 located adjacent the pin end of the tubing 12. An internally threaded connector 44, commonly referred to as a cross-over sub, is threaded on the pin end of the tubing 12 in abutting engagement with the support ring 42 providing a lower stop shoulder for the stack of carbide rings 24. Thus, the carbide rings 24 are compressed between the spring 40 and the supporting 42 and maintained in end face to face contact providing a protective shield for the tubing 12.

The support ring 42 comprises a substantially cylindrical, open ended member. The body of the support ring 42 includes a pair of oppositely located slots or apertures 46 permitting access to the tubing 12. The slots 46 are sufficiently large to permit a pipe wrench or the like to engage the tubing 12; however, the structural integrity of the support ring 42 is not impaired and the support ring 42 will not collapse under the load of the stack of rings 24 supported thereon. The support ring 42 includes an upper collar or shoulder portion in abutting engagement with the lowermost carbide rings 24. A circumferential groove 48 is formed about the external upper collar portion of the support ring 42. The groove 48 cooperates with a corresponding groove in a lower cover ring 58 of a coupling shield assembly 50 for receiving a retaining wire 52 for maintaining the coupling shield 50 in a desired position.

Referring now specifically to FIG. 2B, the movable protective coupling shield 50 of carbide rings 54 is shown lowered about the cross-over sub 44 and coupling 45. The shield assembly 50 includes an internal sleeve 51 supported between an upper cover ring 56 and the lower cover ring 58. The carbide rings 54 are carried about the sleeve 51 between the cover rings 56 and 58. The sleeve 51 has an internal diameter slightly greater than the outer diameter of the carbide rings 24 permitting relative telescoping movement therebetween. The upper and lower cover rings 56 and 58 are welded to the ends of the sleeve 51 at 53 and 55, respectively. The rings 54 are compressed between the cover rings 56 and 58 during assembly of the shield assembly 50, ensuring end face to face contact between adjacent rings 54.

The blast joint 10 described thus far comprises the uppermost tubing joint 12 including a cross-over sub 44 threaded on the pin end thereof. In FIG. 2B, a portion of the intermediate tubing joint 13 is shown. The intermediate tubing joint 13 is provided with a conventional buttress or other non-upset threaded coupling 45 for threadable connection to the pin end of the cross-over sub 44. The intermediate tubing joint 13 is encased by carbide rings 24 much in the same manner as the tubing joint 12. A spring 78 is disposed about the tubing joint 13 in abutment with a shoulder 80 of the coupling 45. A tungsten carbide guide ring 82 and a plurality of carbide rings 24 are slid about the tubing joint 13 and supporting at the lower end thereof by a support ring 42 and a cross-over sub 44 in the same manner as described above regarding tubing joint 12. Any desired number of intermediate joints may be serially connected to provide a blast joint 10 of the required length. Each tubing joint is connected by a cross-over sub thereby eliminating flush joint connections and providing a blast joint whose tensile strength equals or exceeds the tensile strength of the complete tubing string.

The lowermost or bottom tubing joint 15, partially shown in FIG. 2C, is substantially identical to the intermediate tubing joint 13. That is, at the upper end thereof, the tubing joint 15 includes a similar buttress or non-upset coupling 45, compression spring 78, and carbide guide ring 82 as shown in FIG. 2B. Carbide rings 24 are carried on the bottom tubing joint 15 and supported on a lower lock assembly comprising a bowl ring 84 and a slip ring 86 which is substantially identical to the upper lock assembly 26 on the tubing joint 12.

Referring now to FIGS. 2B and 2C, the slip sleeve 90 of the invention is shown. The slip sleeve 90 defines a tubular body journaled about the encased tubular member 13. The slip sleeve 90 is approximately eighteen inches to thirty-six inches in length and is retained about the tubular member 13 between the guide ring 82 and a running ring 83. The slip sleeve 90 may be located on the tubular members comprising the blast joint of the invention at any desired location where a gripping surface is required. Typically, the slip sleeve 90 is located below the coupling 45 so that when suspended in the well bore, the slip sleeve 90 presents a surface for engagement by the pipe slips 92 to support the blast joint in the well bore 14 so that the coupling 45 extends above the drill rig floor 92 for connection to the next tubing joint to form the multi-joint blast joint. The slip sleeve 90 is very sturdy and includes sufficient wall thickness so that it does not collapse upon application of lateral compressive force by the pipe slips 92. By an alternative embodiment, the slip sleeve 9 may include serrations formed on its exterior. Blast joints, particularly when formed of several joints, are extremely heavy. This tremendous load must be supported by the pipe slips 92 which grip the slip sleeve 90. The serrations aid in maintaining a secure gripping contact between the slip sleeve 90 and the pipe slips 92.

Figure 3:
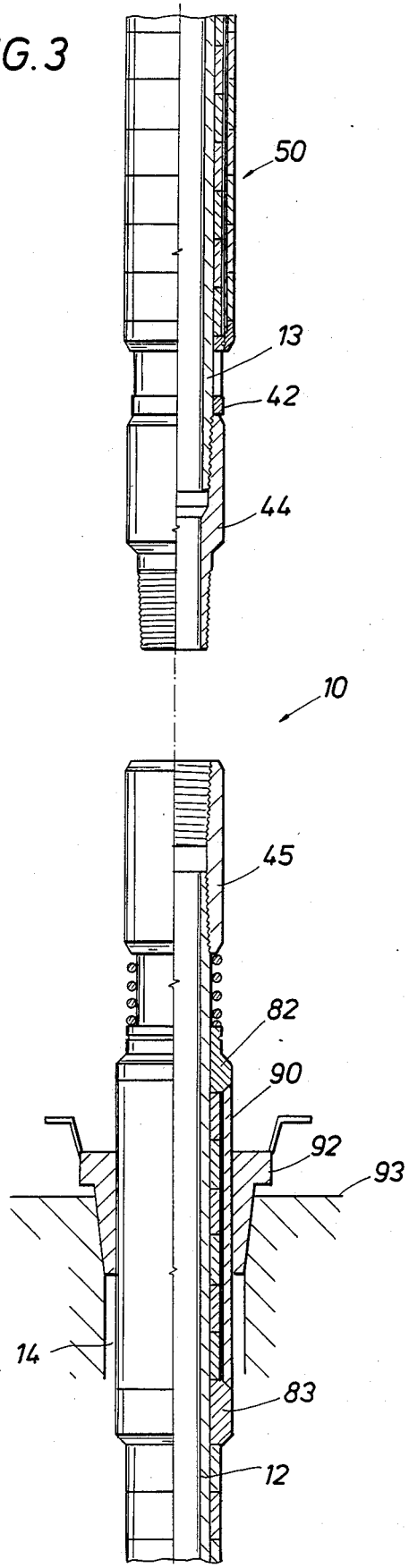
FIGS. 3 and 4 are schematic view showing the installation procedure of the multi-joint blast joint of the present invention.
Figure 4:
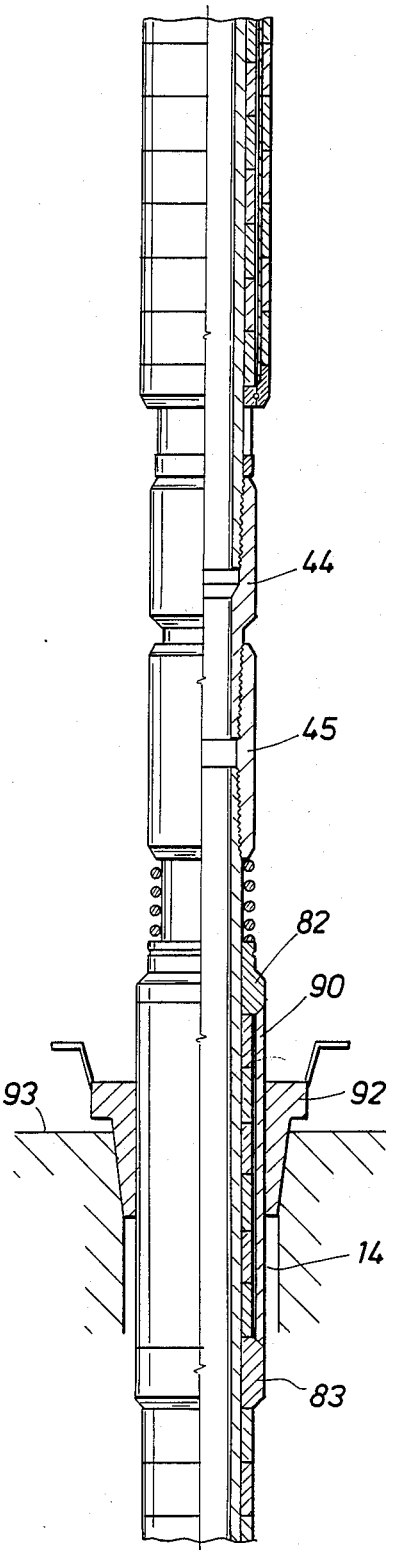

Referring now to FIGS. 3 and 4, the installation procedure of the blast joint of the invention is schematically shown. It will be observed that the lowermost joint 15 forming the blast joint 10 is supported in the well bore 14 by the pipe slips 92 which engage the slip sleeve 90 and are supported by the drill rig floor 93 as shown. The upper end of the tubing joint 15 projects above the drill rig floor 93. The pipe coupling 45 is exposed and may be gripped by the power tongs for making up the connection with the next joint forming the blast joint 10. The intermediate tubing joint is suspended above the drill rig floor 93 in the customary fashion for connection to the tubing joint 12 supported in the well bore 14. In this regard, rig personnel make the connection in the usual manner using the customary rig equipment for making a connection between two joints. That is, power tongs are typically used to engage the cross-over sub 44 and coupling 45 to make the connection.

In FIG. 4 the connection between the two joints has been completed. Prior to removing the pipe slips 92, the coupling shield 50 is lowered about the cross-over sub 44 and coupling 45. The coupling shield 50 is locked to the guide ring 82 in the manner described above to provide a protective shield about the cross-over sub 44 and coupling 45. Once the coupling shield 50 is locked in position, the blast joint string is lifted slightly and the pipe slips 92 are removed. The blast joint string is then lowered into the well bore 14 and supported therein again by engagement of the pipe slips 92 about the slip sleeve journalled about the blast joint tubing 13.

While the foregoing is directed to the preferred embodiment of the present invention, other and further embodiments of the invention may be devised without departing from the basis scope thereof, and the scope thereof is determined by the claims which follow.

What is claimed is:

1. A blast joint, comprising:

(a) at least two tubular members having threaded opposed ends;

(b) a plurality of erosion resistant rings encasing said tubular members;

(c) support means for supporting said erosion resistant rings about said tubular members;

(d) coupling shield means supported on at least one of said tubular members in telescoping relation about said erosion resistant rings;

(e) at least one tubular open ended slip sleeve mounted about said erosion resistant rings on said tubular members for providing a surface for engagement by pipe slips for suspending said tubular members in a well bore; and (f) connector means for connecting said tubular members to form said blast joint.

2. The apparatus of claim 1 including rings means for supporting said slip sleeve on said tubular members, said ring means providing top and bottom support for said slip sleeve for positioning said slip sleeve at a desired location along said tubular members.

3. The apparatus of claim 1 wherein said slip sleeve comprises a tubular body open at each end.

4. The apparatus of claim 3 wherein each end of said tubular body is tapered for engagement with a correspondingly tapered engagement surface formed on said ring means.

5. The apparatus of claim 3 wherein said tubular body of said slip sleeve is eighteen to thirty-six inches in length.

6. The apparatus of claim 2 wherein said coupling shield means is movable between a first and second position for enclosing said connector means upon shifting said coupling shield means to said second position.

7. A blast joint, comprising:

(a) at least two tubular members having threaded opposed ends;

(b) a plurality of erosion resistant rings encasing said tubular members;

(c) support means for supporting said erosion resistant rings about said tubular members;

(d) slip sleeve means mounted about said erosion resistant rings on said tubular members for providing a surface for engagement by pipe slips for suspending said tubular members in a well bore;

(e) connector means for connecting said tubular members to form said blast joint;

(f) coupling shield means supported on said tubular means in telescoping relation about said erosion resistant rings, said coupling shield means being movable between a first and second position, wherein said coupling shield means encloses said connector means upon shifting said coupling shield means to said second position; and (g) wherein said coupling shield means comprises an internal sleeve supported between upper and lower cover rings, said coupling shield means further including a plurality of erosion resistant rings carried about said internal sleeve between said upper and lower cover rings.

8. The apparatus of claim 7 including rings means for supporting said slip sleeve means on said tubular members, said ring means providing top and bottom support for said slip sleeve means for positioning said slip sleeve means at a desired location along said tubular members.

9. The apparatus of claim 7 wherein said slip sleeve means comprises a tubular body open at each end.

10. The apparatus of claim 9 wherein each end of said tubular body is tapered for engagement with a correspondingly tapered engagement surface formed on said guide ring means.

11. The apparatus of claim 9 wherein said tubular body of said slip sleeve means is eighteen to thirty-six inches in length.

12. A blast joint, comprising:

(a) at least two tubular members having threaded opposed ends;

(b) a plurality of erosion resistant rings encasing said tubular members;

(c) support means for supporting said erosion resistant rings about said tubular members;

(d) a tubular open ended slip sleeve mounted about said erosion resistant rings on said tubular members for providing a surface for engagement by pipe slips for suspending said tubular members in a well bore;

(e) coupling shield means supported on said tubular means in telescoping relation about said erosion resistant rings, said coupling shield means being movable between a first and second position, wherein said coupling shield means encloses said connector means upon shifting said coupling shield means to said second position;

(f) said coupling shield means comprising an internal sleeve supported between upper and lower cover rings, said coupling shield means further including a plurality of erosion resistant rings carried about said internal sleeve between said upper and lower cover rings; and (g) connector means for connecting said tubular members to form said blast joint.

* * * * *